United States Patent [19]

Tabuchi

[11] 4,432,634

[45] Feb. 21, 1984

[54] ELECTROPHOTOGRAPHIC COPYING APPARATUS

[75] Inventor: Kenji Tabuchi, Toyokawa, Japan

[73] Assignee: Minolta Camera Kabushiki Kaisha, Osaka, Japan

[21] Appl. No.: 308,173

[22] Filed: Oct. 2, 1981

[30] Foreign Application Priority Data

Oct. 20, 1980 [JP] Japan ..... 55-147122
Aug. 22, 1981 [JP] Japan ..... 56-131922

[51] Int. Cl.[3] ..... G03G 15/06; G03G 15/02
[52] U.S. Cl. ..... 355/14 D; 355/14 CH
[58] Field of Search ..... 355/3 R, 14 E, 14 D, 355/14 CH

[56] References Cited

U.S. PATENT DOCUMENTS

| | | | |
|---|---|---|---|
| 3,762,811 | 10/1973 | Matsumoto | 355/3 |
| 3,788,739 | 1/1974 | Coriale | 355/14 E |
| 4,248,524 | 2/1981 | Takahashi | 355/14 D X |
| 4,256,401 | 3/1981 | Fujimura et al. | 355/14 D X |
| 4,348,099 | 9/1982 | Fantozzi | 355/14 D X |

*Primary Examiner*—Fred L. Braun
*Attorney, Agent, or Firm*—Wenderoth, Lind & Ponack

[57] ABSTRACT

An electrophotographic copying apparatus which is capable of controlling copied image density under the state where the density variation of the line image and that of the solid image are generally kept constant, with a simultaneous increase of the amount of density variation for the line image.

4 Claims, 4 Drawing Figures

ELECTROPHOTOGRAPHIC COPYING APPARATUS

BACKGROUND OF THE INVENTION

The present invention generally relates to an electrophotographic copying apparatus and more particularly, to an electrophotographic copying apparatus provided with an improved image density control arrangement.

Conventionally, in electrophotographic copying apparatuses, laser beam printers, etc., the following methods have been adopted for controlling density of copied images.

(1) A method in which the revolutions of a developing sleeve or a developing magnetic roll are arranged to be variable.

(2) A method in which the potential of a developing bias, i.e. voltage impressed on a developing electrode is adapted to be variable.

However, in the known method (1) as described above, even when the revolutions of the developing sleeve or developing magnetic roll are arranged to be variable, a sufficient amount of the variation can not be obtained in the copied image density, while there is also an upper limit for the increase of revolutions from the aspect of durability of the developing device also. Moreover, in the case where the revolutions of the developing magnetic roll are adapted to be varied as described above, differences in density tend to take place at the leading edge portion and the trailing edge portion of the copied image (particularly lines and characters having large widths) with respect to the developing direction, i.e. moving direction of the electrophotosensitive member or the photosensitive member (referred to as a photosensitive member hereinbelow) with respect to the developing device.

On the other hand, in the conventional method (2) referred to above, even if the developing bias is arranged to be variable, and the surface potential of the photosensitive member is kept constant, the range of density variation for a line image is small due to the presence of the so-called edge effect, and stable copied images are not available, since the density variation for a line image and that for a solid image are quite different from each other owing to variations of the developing bias.

More specifically, for example, in the case where reversal development is effected as in the laser beam printer, the line image is developed mainly based on the edge effect, and the developing density is in proportion to a value represented by $V_0$–Vi, where $V_0$ is the potential charged on the surface of the photosensitive member and Vi is the surface potential of the image portion. On the other hand, the solid image is developed chiefly based on the electrode effect, and the developing density is in proportion to a value represented by $V_B$–Vi, where $V_B$ is the developing bias potential. Therefore, the inconveniences as described earlier still take place, even if the potential for the developing bias is arranged to be variable.

SUMMARY OF THE INVENTION

Accordingly, an essential object of the present invention is to provide an electrophotographic copying apparatus which is capable of controlling the copied image density where the density variation of the line image and the density variation of the solid image are generally kept constant, with a simultaneous increase of the amount of density variation for the line image.

Another object of the present invention is to provide an electrophotographic copying apparatus of the above described type which has a simple construction and functions stably with high reliability, and can be readily manufactured at low cost.

In accomplishing these and other objects, according to one preferred embodiment of the present invention, there is provided an electrophotographic copying apparatus which includes an electrophotographic member or photosensitive member, means for charging the photosensitive surface of the photosensitive member uniformly, means for supplying electric power to the charging means, means for projecting light onto the photosensitive surface of the photosensitive member to form an electrostatic latent image on the photosensitive surface, means having a developing electrode for developing the electrostatic latent image, means for applying developing bias potential to the developing electrode, with at least one of the electric power to be supplied to the charging means and the potential to be applied to the developing electrode being adjustable, and means for controlling the charged potential of the photosensitive surface of the photosensitive member charged by the charging means and the developing bias potential applied to the developing electrode by the developing bias potential applying means in association with each other, when said adjustment is effected.

By the arrangement according to the present invention as described above, an improved electrophotographic copying apparatus has been advantageously provided which substantially eliminates the disadvantages inherent in the conventional arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
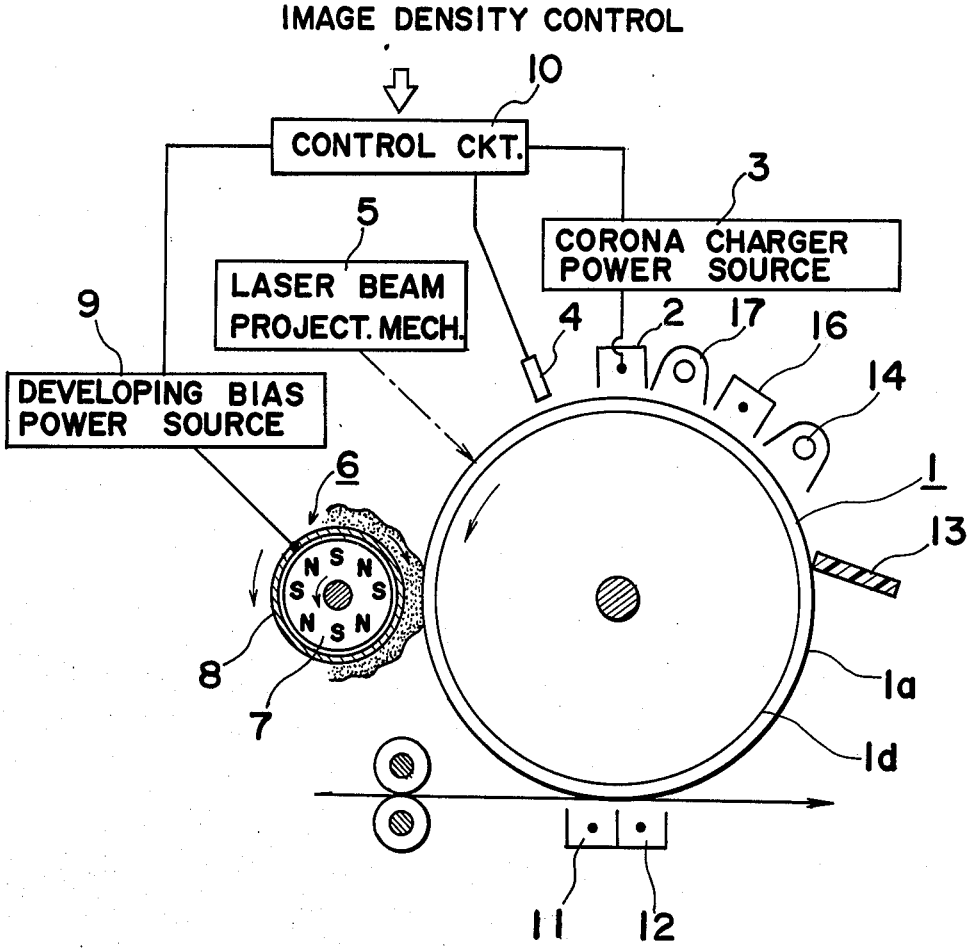
FIG. 1 is a schematic diagram showing an essential portion of an electrophotographic copying apparatus according to one preferred embodiment of the present invention.

Referring now to the drawings, there is schematically shown in FIG. 1, an essential portion of an electrophotographic copying apparatus according to one preferred embodiment of the present invention which includes a photosensitive drum 1 constituted by a photosensitive layer 1*a* of $As_2Se_3$ deposited on a surface of an aluminum drum 1*d* and arranged to be driven in rotation in the counterclockwise direction as shown by the arrow in FIG. 1 at a circumferential speed of 170 mm/sec. Around the photosensitive drum 1, there are sequentially disposed various processing stations and devices such as a corona charger 2 connected to a corona charger power source 3 which is coupled to a control circuit 10, a charge potential detector 4 also connected to the control circuit 10, a laser beam projecting mechanism 5, a magnetic brush type developing device 6 connected to a developing bias power source 9 which is further coupled to the control circuit 10, a transfer charger 11 for corona discharging of a negative polarity (−), an A.C. charger 12 for copy paper separation, a cleaning blade 13 for removing residual toner remaining on the photosensitive surface 1*a* after the transfer, a main eraser lamp 14, a sub-charger 16 for corona discharging of a positive polarity (+), and a sub-eraser lamp 17 operable in a manner as described hereinbelow.

More specifically, the corona charger 2 is connected to the power source 3 for charging the photosensitive surface 1*a* of the drum 1 to a positive polarity (+) with electric power of positive polarity (+) supplied from the power source 3, and the charge potential detector 4 is coupled to a control circuit 10 and disposed adjacent to the corona charger 2 and is adapted to detect the surface potential of the photosensitive drum 1 immediately after it has been charged by the corona charger 2. The laser beam projecting mechanism 5 is arranged to project the laser beam only onto the image portion at a constant amount of irradiation of 10 $\mu J/cm^2 \cdot sec$. The image to be dealt with is a black and white pattern without a medium contrast, and the surface potential of the photosensitive drum 1 at its portion subjected to the irradiation as described above is attenuated to approximately 25 V.

On the other hand, the magnetic brush developing device 6 includes a developing sleeve 8 in which a magnetic roll 7 is rotatably accommodated, and the magnetic roll 7 is provided, for example, with eight magnetic poles of alternately different polar orientation arranged in the circumferential direction thereof and is rotated in the counterclockwise direction as indicated by the arrow in FIG. 1 at a speed of 1,000 rpm. The developing sleeve 8 having an external diameter of 31 mm is also be rotated in the counterclockwise direction as indicated by the arrow at a speed of 20 rpm. For a developing material, a mixture of 94% by weight of small diameter magnetic carrier particles and 6% by weight of electrically insulative toner particles is employed. The small diameter magnetic carrier particles composed of magnetic fine particles dispersed in a resin material have an average particle diameter of 21 $\mu m$, a resistance value of $10^{14}$ $\Omega \cdot cm$, and negative triboelectrical charging polarity (−) with respect to the toner particles, while the toner particles of electrically insulative and non-magnetic characteristics have a positive triboelectrical charging polarity (+) with respect to the carrier particles.

The developing material as described above is formed into a magnetic brush on the outer peripheral surface of the developing sleeve 8 by the magnetic force of the magnetic roll 7 and transported in the clockwise direction as indicated by the arrow along the peripheral surface of the developing sleeve 8 mainly based on the rotation of the magnetic roll 7 so as to subject an electrostatic latent image formed on the photosensitive surface 1*a* of the drum 1 to a reversal development. In other words, the toner particles charged with the positive polarity (+) are caused to adhere onto the image portion whose charge is attenuated to about 25 V through projection of the laser beam by the laser beam projecting mechanism 5 as described earlier. In the above case, a developing gap i.e. clearance between the developing sleeve 8 and the photosensitive drum 1 is set to be 0.7 mm. The developing sleeve 8 is impressed with a developing bias of a positive polarity (+) from a developing bias power source 9 so as to function as a developing electrode.

The control circuit 10 for effecting adjustments of the image density is arranged to control the charging potential on the photosensitive surface 1*a* of the photosensitive drum 1, together with the developing bias potential, and the impressed potential for the developing bias is determined so as to satisfy the relation represented by $$V_B = V_0 - 200 \text{ V} \quad (1)$$

where $V_B$ is the developing bias potential, and $V_0$ is the charged potential of the photosensitive surface 1*a* of the drum 1 detected by the detector 4 described earlier.

Figure 2:
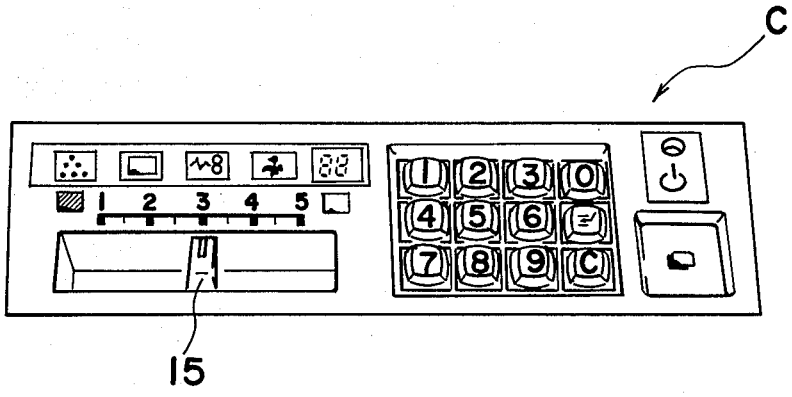
FIG. 2 is a perspective view of a control panel employed in the copying apparatus of FIG. 1.

More specifically, referring also to FIG. 2 showing a control panel C employed in the copying apparatus of FIG. 1, when an image density control knob 15 slidably provided on the control panel C is manually operated, the resistance value of a variable resistor (not particularly shown) provided in the panel C is varied for adjusting the power supplied to the corona charger 2 so as to correspond to the variation in the resistance value. In the above case, the image density becomes dark as the knob 15 approaches a graduation "1", and the charged potential is adjusted, for example, to 450 V upon alignment of the knob 15 with the graduation "1", to 350 V upon alignment thereof with a graduation "3", and to 250 V upon alignment thereof with a graduation "5".

The charged potential on the photosensitive surface 1*a* of the drum 1 thus imparted by the corona charger 2 through adjustments in the manner as described above, is detected by the charge potential detector 4, and the developing bias having the potential value determined in the control circuit 10 based on the earlier described formula (1) is impressed onto the developing sleeve 8 through the power source 9. In other words, adjustments are so made that, if the charged potential is 450 V, the developing bias potential becomes 250 V, and if the charged potential is 350 V, the developing bias potential becomes 100 V, and if it is 250 V, the charged potential becomes 50 V, respectively, with the absolute value of the potential difference between the charged potential and developing bias potential being maintained at 200 V.

Figure 3:
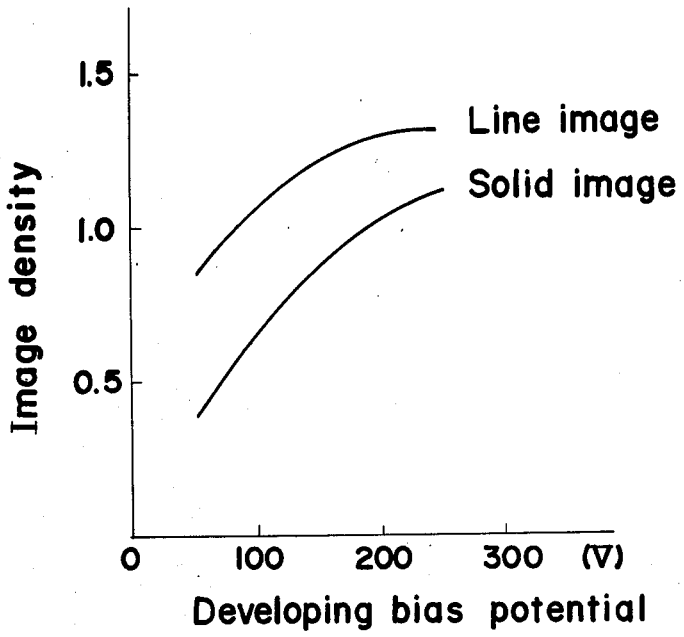
FIG. 3 is a graph explanatory of the variation of image density in the copying apparatus according to the present invention.

Reference is further made to the graph of FIG. 3 showing variations of the image density when the charging potential $V_0$ is altered within the range of 250 to 450 V in the first embodiment described thus far. In the graph of FIG. 3, the developing bias potential $V_B$ on the abscissa varies within the range of 50 and 250 V based on the formula (1) described earlier. In the above graph, data for the line images are measured from copying line images of 0.5 mm in width, while data for the solid images are measured at central portions of copied solid images of 5×5 cm square.

Figure 4:
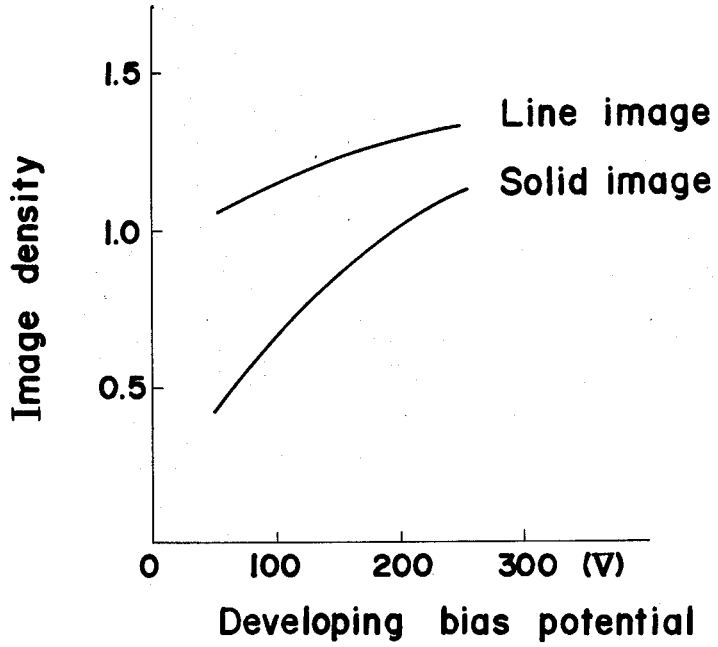
FIG. 4 is a graph explanatory of the variation of image density in a comparative example.

In FIG. 4, there is shown a comparative graph showing variations of the image density in the case where the developing bias potential $V_B$ is altered within the range of 50 to 250 V, and the charged potential $V_0$ remains fixed at 450 V in the copying apparatus of FIG. 1.

As is seen from the above two graphs in the graph of FIG. 3 according to the present invention, the density variations for the line image is larger than that in FIG. 4 so as to more closely approximate the density variation characteristic curve for the solid image, and the density variation for the line image and that for the solid image are maintained approximately constant even with variation of the developing bias voltage. The increase of the density of the line image is attributable to the fact that, by maintaining a constant potential difference $|V_0-V_B|$ between the charged potential $V_0$ on the photosensitive surface and the developing bias potential $V_B$, the developing itself based on the edge effect is also affected. Moreover, if the potential difference $|V_0-V_B|$ is held constant, the undesirable generation of fogging following the developing density control is advantageously prevented.

It should be noted here that the detection of the charged potential by the detector 4 described as employed in the foregoing first embodiment may be omitted depending on necessity, and the arrangement may be so modified that the developing bias potential $V_B$ is automatically adjusted by the control circuit 10 in correspondence with the variation of the resistance value by the manipulation of the knob 15 (i.e. selection of the charged potential $V_0$).

By way of example, the arrangement in the first embodiment of FIG. 1 may be so modified that the control circuit 10 controls the developing bias potential and the surface potential of the photosensitive surface 1*a* so that electric power corresponding to each of the potential values respectively selected by the control circuit 10 is supplied to the developing sleeve 8 and the corona charger 2 through the developing bias power source 9 and corona charger power source 3. The value detected by the detector 4 for detecting the surface potential of the photosensitive surface 1*a* immediately after the charging by the corona charger 2, is fed back to the control circuit 10 to see if the actual surface potential is the same as the selected value so that the power supplied to the corona charger 2 can be corrected if necessary.

More specifically, a constant developing bias potential value is preliminarily selected, and electric power corresponding to said selected potential value is supplied to the developing sleeve 8 from the developing bias power source 9. Simultaneously, the surface potential of the photosensitive surface having an approximately constant potential difference with respect to said selected developing bias potential value is chosen by the control circuit 10, and electric power corresponding to said chosen potential value is supplied to the corona charger 2 by the corona charger power source 3. In the above case, the electric power supplied to the corona charger 2 may of course be corrected by the feeding back of the detected value from the detector 4.

It is to be noted here that in the above modification, the detector 4 is intended to correct the power to be supplied to the corona charger 2, while in the first embodiment of FIG. 1, the detector 4 is used to determine the developing bias.

A second embodiment of the present invention will be described hereinbelow, in which the apparatus fundamentally similar to that in FIG. 1 is employed except for the function of the control circuit 10, and the image density adjusting knob 15 shown in FIG. 2 is replaced by three selecting switches H, M, and L (not particularly shown) for the image density adjustments provided on the control panel. In the second embodiment of the present invention as described above, by turning ON any one of the selecting switches H, M and L, a predetermined electric power is supplied to the corona charger 2, and at the same time a developing bias having a predetermined potential value is applied to the developing sleeve 8 so that the potential difference between the charged potential $V_0$ and the developing bias potential $V_B$ is maintained at an approximately constant value by the control circuit 10. It is to be noted here that in the second embodiment as described above, the charged potential detected by the detector 4 is fed back to the control circuit 10 for comparison with a reference potential memorized in the control circuit 10, and the power supplied to the corona charger 2 is subjected to fine adjustments so as to bring the charged potential to a predetermined value.

More specifically, in the second embodiment of the present invention as described above, when the respective switches H, M, and L are turned ON, electric power which will provide the charged potentials $V_0$ and developing bias potentials $V_B$ as shown in the table below are supplied to and impressed on the corona charger 2 and the developing sleeve 8.

| Selection switch | Charged potential ($V_0$) | Developing bias potential ($V_B$) | Potential difference $\|V_0-V_B\|$ | Line image density | Solid image density |
|---|---|---|---|---|---|
| H | 450 | 200 | 250 | 1.3 | 1.0 |
| M | 350 | 100 | 250 | 1.0 | 0.5 |
| L | 250 | 25 | 225 | 0.7 | 0.2 |

It should be noted here that in the second embodiment as described thus far, when either the power supplied to the corona charger 2 or the potential impressed to the developing sleeve 8 is increased, and more specifically, when the selecting switch is changed over from the switch L to the switch M, the absolute value of the potential difference as stated earlier is slightly increased from 225 V to 250 V. In the above second embodiment, it is taken into account that charging irregularity on the surface of the photosensitive surface of the photosensitive drum 1 becomes conspicuous as the charged potential increases, thus resulting in formation of undesirable fogging. In other words, by the arrangement as described above, the generation of fogging is effectively prevented.

It is also to be noted that in the first and second embodiments of the present invention as described in the foregoing, the charged potential $V_0$ should preferably be lower than 700 V, and that the potential difference $|V_0-V_B|$ should preferably be within the range of 25 and 300 V, since, in these embodiments, if the charged potential $V_0$ exceeds 700 V, irregular or uneven fogging tends to take place in the developed image, while when the potential differences $|V_0-V_B|$ exceeds 300 V, carrier particles adhere to the non-image portion, and if it is below 25 V, the developed image is subjected to fogging.

As is clear from the foregoing description, according to the present invention, since at least either the electric power supplied to the charging means or the potential applied to the developing electrode is adjustable, and there is provided the means for controlling the charged potential of the photosensitive surface to be charged by said charging means and the developing bias potential to be applied to said developing electrode by the developing bias potential applying means in association with each other, when the adjustment is effected, it is possible to increase the density variation for the line image on a density variation characteristic curve for the line image which is an approximation of that of the solid image, and thus, the density variation for the line image and that for the solid image may be maintained approximately constant to provide stable copied images, even when the potential value of the developing bias fluctuates.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed being included therein.

What is claimed is:

1. An electrophotographic copying apparatus which comprises:

a photosensitive member having a photosensitive surface;

means for uniformly charging the photosensitive surface of said photosensitive member to a charged potential;

an adjustable electric power supplying means connected to said charging means for supplying electric power to said charging means;

means for projecting light onto the photosensitive surface to form an electrostatic latent image on said photosensitive surface;

means having a developing electrode for reversal development of said electrostatic latent image;

an adjustable developing bias potential applying means connected to said developing electrode for applying a developing bias potential to said developing electrode which is different from said charge potential;

image intensity varying means connected to said electric power supplying means and to said developing bias potential applying means for adjusting at least one of the electric power supplying means and said developing bias potential applying means for varying the intensity of said image; and control means to which said image intensity varying means is connected and connected to said electric power supplying means and to said developing bias potential applying means for controlling at least the other of said electric power supplying means and said developing bias potential applying means for maintaining an approximately constant absolute value of voltage difference between said charge potential and said developing bias potential in response to an adjustment of at least one of the electric power supplying means and said developing bias potential applying means, whereby the shape of the density variation characteristic curve of the line portions of the image and the shape of the density variation characteristic curve of the solid portions of the image are kept substantially the same.

2. An electrophotographic copying apparatus as claimed in claim 1, wherein said control means comprises means for controlling the charged potential and said developing bias potential in relation to each for increasing the absolute value of the difference between said charged potential and said developing bias potential to a predetermined slight extent when said one of said electric power supplying means and said developing bias potential applying means is adjusted to increase the potential thereof.

3. An electrophotographic copying apparatus as claimed in claim 1, wherein said control means comprises means for maintaining a substantially constant difference between said charged potential and said developing bias potential.

4. An electrophotographic copying apparatus as claimed in claim 1, wherein said control means includes means for detecting said charged potential and for controlling said developing bias potential in response to the detected value of the charged potential.

* * * * *